US006802428B2

(12) United States Patent
Ekkert

(10) Patent No.: US 6,802,428 B2
(45) **Date of Patent: *Oct. 12, 2004**

(54) APPARATUS AND METHOD ALLOWING GAS FLOWING INTO AND/OR OUT OF CONTAINER

(75) Inventor: Leonard Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/077,367

(22) Filed: Feb. 15, 2002

(65) Prior Publication Data

US 2003/0155323 A1 Aug. 21, 2003

(51) Int. Cl.[7] ..... B65D 51/16
(52) U.S. Cl. ..... 215/307; 215/354
(58) Field of Search ..... 215/307, 354, 215/344, 252, 345, 44, 40, 45, 316, DIG. 1, 363; 422/25

(56) References Cited

U.S. PATENT DOCUMENTS

| | | | | | |
|---|---|---|---|---|---|
| 3,179,276 | A | * | 4/1965 | Safianoff | 215/307 |
| 3,610,306 | A | * | 10/1971 | Summers | 215/270 |
| 3,784,041 | A | | 1/1974 | Birch | 215/40 |
| 3,802,590 | A | | 4/1974 | Culver | 215/40 |
| 3,815,771 | A | | 6/1974 | Marks | 215/344 |
| 3,854,618 | A | | 12/1974 | Beghnini | 215/307 |
| 3,944,104 | A | * | 3/1976 | Watson et al. | 215/307 |
| 4,089,463 | A | * | 5/1978 | Babiol | 215/329 |
| 4,090,631 | A | | 5/1978 | Grussen | 215/329 |
| 4,106,653 | A | * | 8/1978 | Martinelli | 215/256 |
| 4,143,785 | A | | 3/1979 | Ferrell | 215/270 |
| 4,196,818 | A | * | 4/1980 | Brownbill | 215/252 |
| 4,276,989 | A | | 7/1981 | Hicks | 215/270 |
| 4,351,443 | A | * | 9/1982 | Uhlig | 215/216 |
| 4,442,947 | A | | 4/1984 | Banich, Sr. | 215/344 |
| 4,450,973 | A | * | 5/1984 | Toeppen | 215/329 |
| 4,560,077 | A | | 12/1985 | Dutt | 215/307 |
| 4,566,603 | A | | 1/1986 | Moore | 215/329 |
| 5,129,533 | A | | 7/1992 | Loffler | 215/344 |
| 5,161,707 | A | | 11/1992 | Dutt et al. | 215/344 |
| 5,762,218 | A | | 6/1998 | Sachau | 215/320 |
| 5,782,369 | A | | 7/1998 | Tansey | 215/344 |
| 5,871,111 | A | | 2/1999 | Pfefferkorn et al. | 215/307 |
| 5,931,323 | A | * | 8/1999 | Wilkinson et al. | 215/228 |
| 5,972,292 | A | * | 10/1999 | DeMeo | 422/25 |
| 6,003,699 | A | * | 12/1999 | Laszlo et al. | 215/43 |
| 6,223,919 | B1 | * | 5/2001 | Kuehn | 215/252 |
| 6,257,432 | B1 | * | 7/2001 | Ekkert | 215/331 |
| 6,260,722 | B1 | * | 7/2001 | Ekkert | 215/331 |

FOREIGN PATENT DOCUMENTS

| | | | | |
|---|---|---|---|---|
| GB | 2120219 | * | 11/1983 | 215/307 |
| NL | 8004036 | | 7/1980 | |
| WO | WO 01/43554 A1 | | 6/2001 | |

* cited by examiner

*Primary Examiner*—Lien Ngo
(74) *Attorney, Agent, or Firm*—Welsh & Katz, Ltd.

(57) ABSTRACT

A container assembly comprises a container having a sealing surface, and a cap having a sealing surface. The sealing surface of the container, the cap, or both is prepared by either being made of a coarse texture or polished so that the sealing surface of the container and the cap may cooperate with one another to form a seal, yet allow gas to flow into or out of the container assembly, as required.

7 Claims, 4 Drawing Sheets

FIG. 1
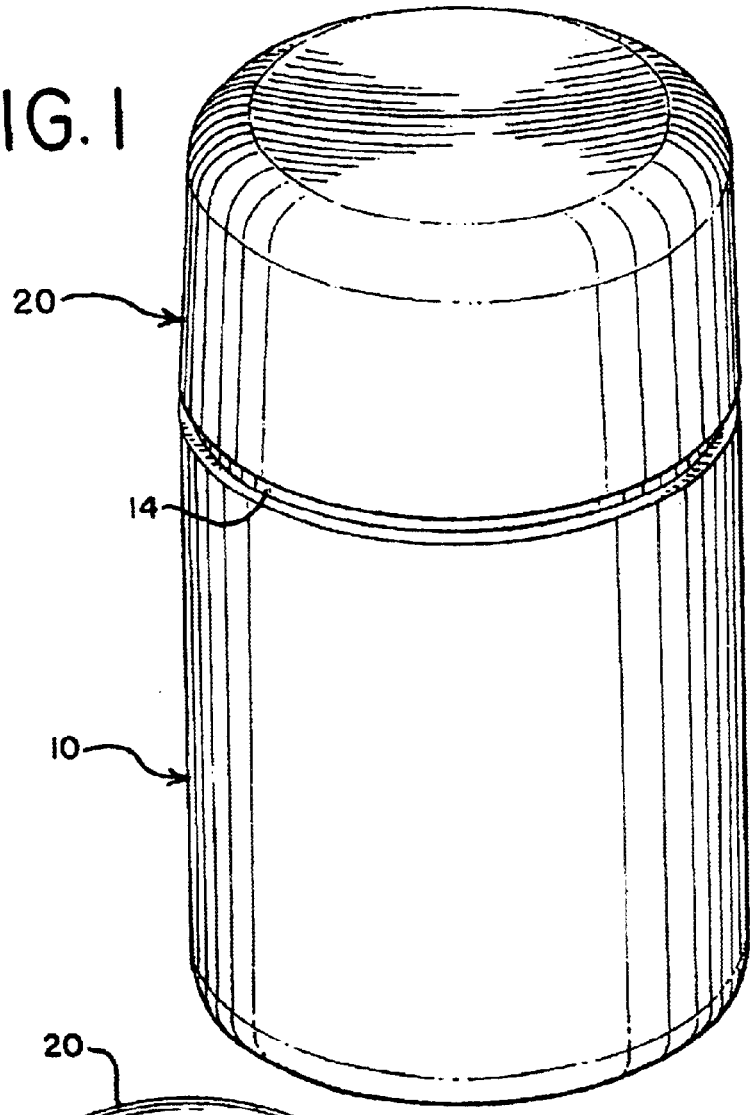
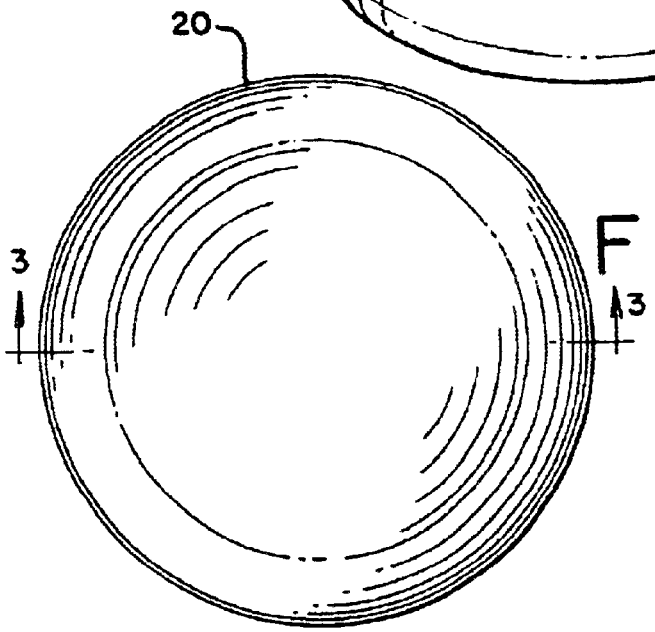
FIG. 2

APPARATUS AND METHOD ALLOWING GAS FLOWING INTO AND/OR OUT OF CONTAINER

BACKGROUND OF THE INVENTION

This invention relates to containers which can be opened and closed while continuing to achieve a seal between the cap and the container and also allowing for gas flow into and/or out of the container.

A good seal is especially desirable if the substance in the container needs protection from the outside environment, such as a powdered beverage mix which can cake with continuous exposure to very humid air. It is desirable to be able to manufacture an inexpensive cap and container assembly, which can be used for initial packaging of the product prior to sale, and which can continue to be opened and resealed by the purchaser of the product.

It is also desirable to allow for gas to flow into and/or out of the container, while still maintaining a sufficient seal, to reduce or prevent denting or bursting of the container, which can be caused when a sealed container assembly is moved from a high altitude to a low altitude or moved from a low altitude to a high altitude.

Some existing containers are too expensive for the packaging of inexpensive products, difficult to reseal effectively, or simply cannot be resealed effectively. Existing containers often do not permit gas to flow into and/or out of the container, likely causing the undesirable denting described above.

SUMMARY OF THE INVENTION

The invention pertains to a method and apparatus allowing for gas flow into and/or out of a container assembly. The container assembly comprises a container having a sealing surface, and a cap having a sealing surface. The sealing surfaces of the container or the cap or both given a texture that is polished or made coarser, as desired In this way the sealing surface of the container and the cap cooperate with one another to form a seal and to allow gas to flow into or out of the container assembly.

In one embodiment, the container includes a base and a neck and the cap includes a protrusion. In such an embodiment, at least a portion of the neck is the sealing surface of the container, and at least a portion of the protrusion is the sealing surface of the cap.

The sealing surfaces cooperate with one another, and temporarily deform a shape of the cap, the neck and/or both. The cooperation also forms a seal between the cap and the container, and in one embodiment, an extent of the deformation can be limited by contact between stopping surfaces, blocking tighter engagement of the cap with the container.

BRIEF DESCRIPTION OF THE DRAWINGS

FIG. 1 is a side perspective view of the cap and container assembly with the cap secured to the container;

FIG. 2 is a top perspective view of the cap and container assembly;

DETAILED DESCRIPTION OF THE INVENTION

The invention pertains to a method and apparatus for controlling gas flow into or out of a container assembly that is comprised of a cap 20 and a container 10. The container 10 and the cap 20 each have a sealing surface, and the sealing surfaces cooperate with one another. The sealing surface of the cap 20, the sealing surface of the container 10, or both, are prepared by providing a coarse texture to the surface or polishing to allow for gas to flow into and/or out of the container assembly, as required.

FIGS. 1 through 4 show a first embodiment of a container assembly embodying aspects of the invention. The first embodiment comprises a container 10 and a cap 20 designed for mating engagement with each other and to allow for gas flow into and/or out of the container assembly. The container 10 and cap 20 are ideally manufactured as molded plastic parts, preferably composed of a thermoplastic material such as polypropylene, polyethylene, polyethylene terepthlate, polyvinyl cloride, polycarbonate, or similar materials.

Figure 3:
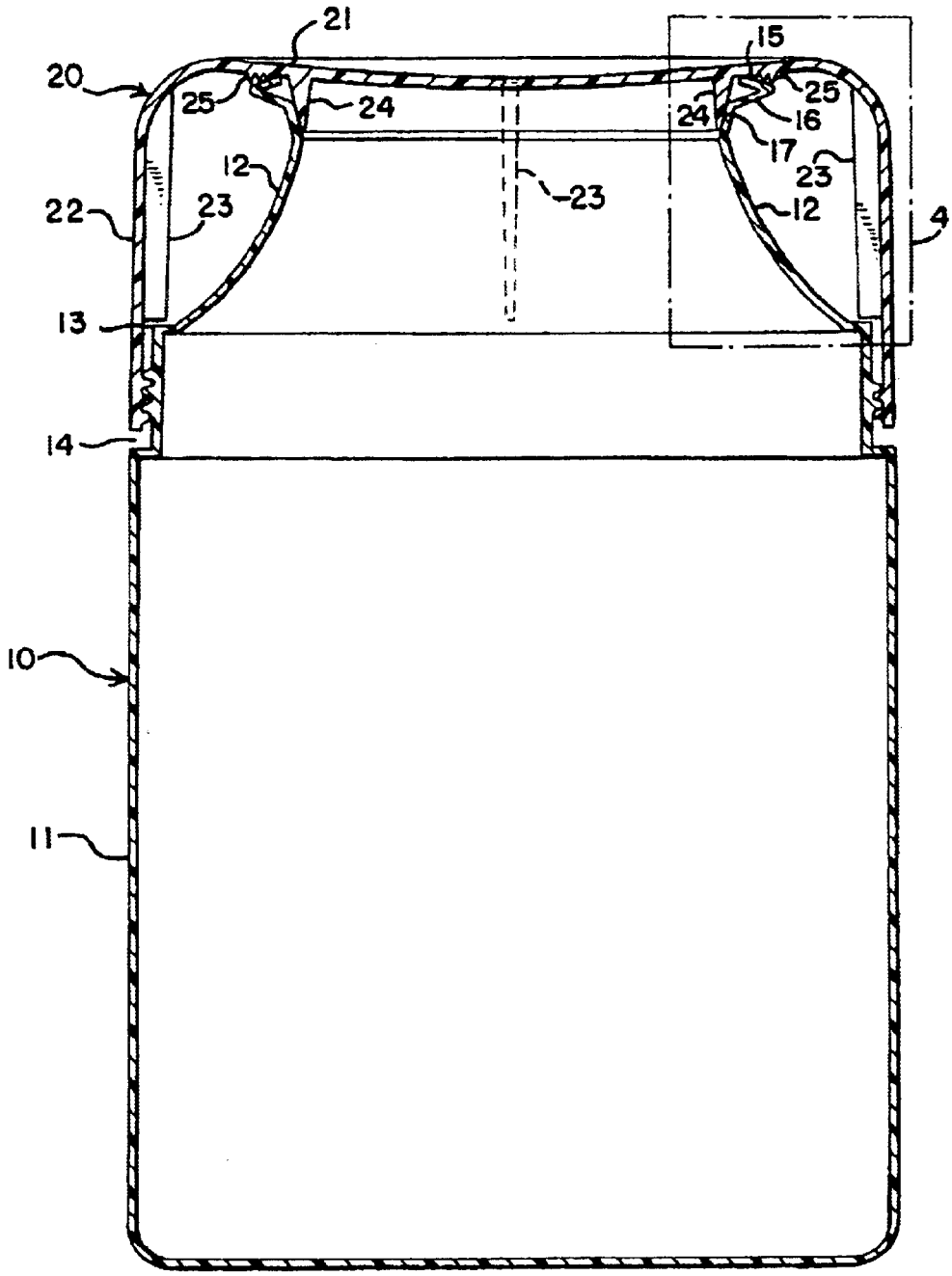
FIG. 3 is a cross-sectional view taken along line 3—3 depicted in FIG. 2.

The first embodiment in FIG. 3 shows the container 10 including a base 11 and a neck 12. The neck 12 is the portion of the container 10 to which the cap 20 is engaged, and the end of the neck 12 defines a mouth of the container. The cap 21 includes a curved top 21 and a skirt 22 depending peripherally from the top 21. A portion of the exterior surface of the neck 12 is threaded, a portion of the interior surface of the skirt 22 is threaded, and the cap 20 can be secured to the container 10 by mating engagement of those two threaded-portions. In the alternative the cap 20 may be secured to the container by a snap fit, as known in the art.

Figure 4:
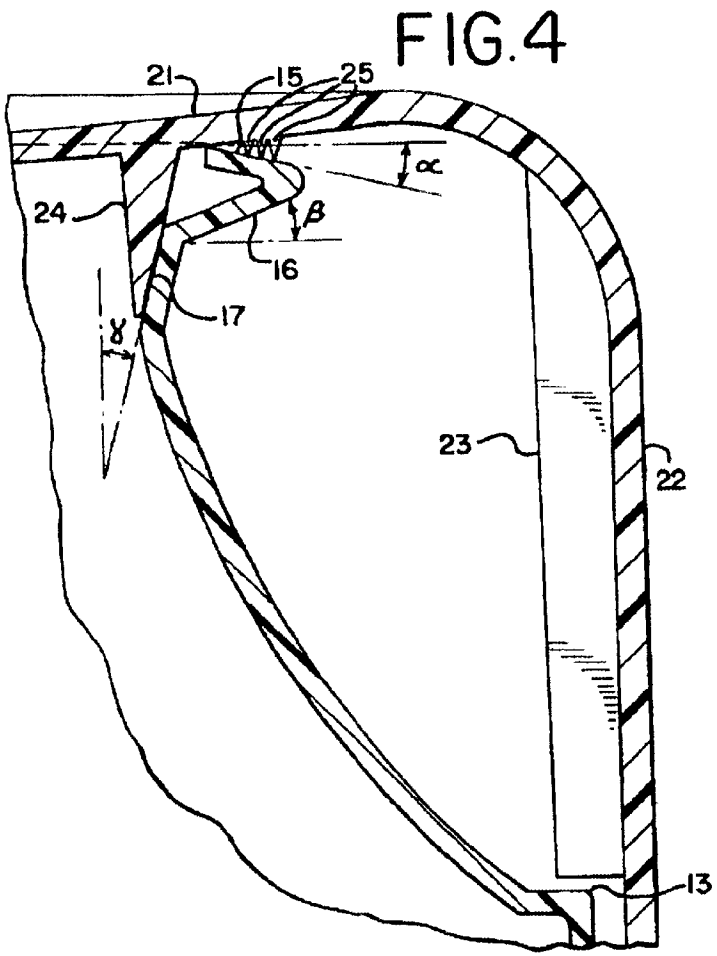
FIG. 4 is an enlarged view of the identified portion in FIG. 3.

Also shown in FIG. 3, may be a number of stops or projections 23 on the interior surface of the skirt 22 that are designed to contact a shoulder 13 on the exterior surface of the neck 12 at some time as the cap 20 is secured to the container 10. The cap can also bottom out on a ledge of the container which provides the stopping surface, as known in the art. Those projections 23 and shoulder 13 act as stopping surfaces to block any tighter engagement of the cap 20 and the container 10 and to provide a gap 14 between a bottom edge of the cap 20 and an upper part of the base 11. The gap 14 can be provided by other means such as a step in exterior of container. In FIGS. 3 and 4, the shoulder 13 is seen above the threaded portion of the exterior surface of the neck 12.

In the first embodiment, a relatively long sealing flange or first annular protrusion 24 depends from an interior surface of the top. In one variation of the first embodiment, at least one second annular protrusion 25 can also depend from an interior surface of the top 21, and preferably, as shown in FIGS. 3 and 4, a plurality of smaller second annular protrusions 25 depend from the interior surface of the top 21. At least a portion of the first annular protrusion 24 serves as a cap sealing surface. In the first embodiment shown in FIGS. 3 and 4, portion(s) 32 of the smaller second annular protrusions 25 can also serve as cap sealing surfaces.

The top 21 is generally convex as viewed from inside the cap 20. The neck 12 is substantially symmetrical about a central vertical axis. As the neck 12 extends down from the mouth, it is preferable if the neck 12 initially doubles back creating a flexible lip. The neck then has an interior third surface 17 at least a portion of which cooperates with one of the sealing surfaces of the cap 20, which is preferably at least a portion of the first protrusion 24 described above. This effectuates a substantial seal. The seal is sufficient to prevent undue leakage of materials and to prevent undue exposure of materials to the environment.

The neck 12 then extends down to the threaded portion. That is, the neck 12 initially becomes wider forming an angle of about 1° to 40° and preferably 15° with an imaginary horizontal plane in an unstressed state. At least a portion 32 of one of the second annular protrusions 25 of FIGS. 3 and 4, and preferably at least a portion 32 of each of the second annular protrusions, are positioned to cooperate with at least a portion of the first surface 15 of the exterior of the neck 12. This effectuates a substantial seal that prevents undue leakage of materials and undue exposure of materials to the environment. It is preferable that the neck 12 then become narrower first forming an exterior second surface 16 at an angle of approximately 20° with an imaginary horizontal plane, and second becoming more vertical while continuing to narrow and forming an angle of approximately 14° with a surface of an imaginary vertical cylinder (in an unstressed state). At least a portion 31D of the first annular protrusion 24 can cooperate with at least a portion of the third surface 17 of the interior of the neck 12. The neck 12 can then become wider than the lip as it continues down to meet the base 11.

In the first embodiment shown in FIGS. 3 and 4, the sealing surface of the container is at least a portion of the first surface 15 of the neck 12. The container 10 can also have a second sealing surface, which can be at least a portion of the third surface 17 shown in FIG. 4. The cap also has at least one sealing surface, and preferably has two sealing surfaces. The first cap sealing surface is at least a portion of the first protrusion 24 and the second cap sealing surface is at least a portion 32 of one or all of the second protrusions 25. The sealing surfaces of the container 10 and cap 20 cooperate with one another, preferably effectuating a seal.

Pursuant to aspects of the invention, at least one of the sealing surfaces is prepared to make the surface coarser or polished, as desired. As shown in the figures, the two sealing surfaces of the container 10 (at least a portion of the first surface 15 and at least a portion of the third surface 17) and the two sealing surfaces of the cap 20 (at least a portion 30 of the first protrusion 24 and at least a portion 32 of one or all of the second protrusions 25) are prepared. In other embodiments not shown, only one of the sealing surfaces, two of the sealing surfaces, or any other combination, can be prepared. Roughening or coarsening the sealing surfaces allows for gas to flow into and/or out of the container assembly while still maintaining a sufficient seal. Otherwise, without coarsening, gas may not be able to flow into and/or out of the container assembly, which can cause, in the extreme, container imploding or bursting. For example, during transport of empty container assemblies, the container assemblies might be sealed and prevent gas flow into and/or out of the container assemblies. As a result, if the container assemblies are sealed at a low pressure (highaltitude) and then transported to a high pressure (low altitude), the surface of the containers can deform and can potentially collapse or implode. Conversely, if the container assemblies are sealed at high pressure (low altitudes) and transported to low pressure (high altitudes), the container assemblies can bubble and can potentially burst. If the cap and/or the container seal surfaces are made coarse, however, gas may flow into and/or out of the container assembly, allowing for the pressure inside the container assembly to substantially equilibrate with the increased or lowered pressure, reducing the possibility of the deformations described above. Preferably, the sealing surfaces are sufficiently coarsened to allow for gas to flow into and/or out of the container assembly to prevent deformation while still maintaining a sufficient seal to reduce or prevent undue exposure of materials within the container to the environment. Alternatively the sealing surfaces may be polished to provide a tighter seal for increased pressure or vacuum retention.

Figure 6:
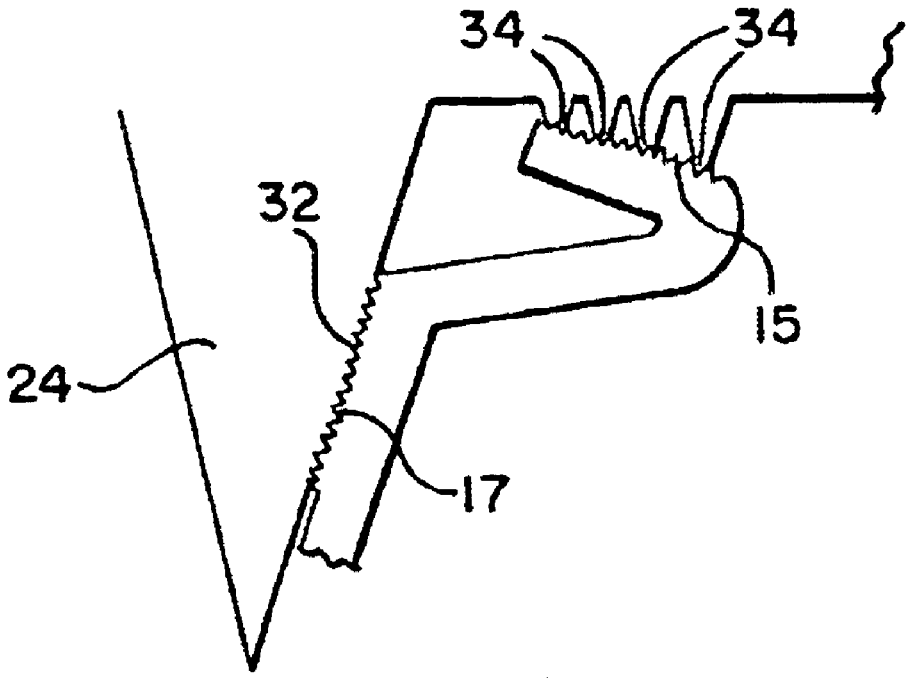

Preferably, the sealing surfaces are roughened to values that range from about 1201 E. to about 1412 E., as shown in FIG. 6. Some common roughness values used to allow for sufficiently roughened surfaces include: E values from a fine grain to coarse grain, i.e., 1201; 1202; 1203; 1204; 1205; 1401; 1407; 1411; 1412; 2302; 2303; 2704; and 3104 E. The surfaces may also be polished from a dull surface to an optical quality surface, or from DME1, 2, 3 or 4.

The first, second and third surfaces 15, 16, and 17, like all of the neck 12 in the example illustrated by FIGS. 1 through 4, curve symmetrically about a central vertical axis. However, the first, second, and third surfaces 15, 16, and 17, may be characterized as "flat," in that the intersections of those surfaces 15, 16, and 17 with any plane which included the central vertical axis would be straight line segments rather than curved line segments. As seen in FIG. 4, the angles of surfaces 15, 16, and 17 mentioned above would be the angle of such a straight line segment with its projection on the imaginary surface indicated.

With the first embodiment just described, and illustrated in FIGS. 3 and 4, the first annular protrusion 24 will protrude down further from the top 21 than the second protrusions 25, as both are designed to cooperate with a particular surface area of the neck 12, in order to effectuate a seal. It is preferable that materials and the geometry of the top 21, the first protrusion 24, and the neck 12 render them sufficiently flexible to allow for some temporary deformation of shape. This is facilitated by the curvature of the top 21 and the bends in the neck 12. The temporary deformation results from the pressure exerted as the cap 20 is secured to the container 10. The resilience of the materials used maintains that pressure and the resulting good seal between the cap 20 and the container 10.

It is preferable that the angles, of the first annular protrusion 24 and of the third surface 17 of the neck 12 are generally matched to achieve a good seal at the tightest engagement permitted by the stopping surfaces 13 and 23. Similarly, as seen in FIGS. 3 and 4, the lengths of the second annular protrusions 25 will vary to match the angle of the first surface 15 of the exterior of the neck 12 with which the second protrusions 25 cooperate with. Of course, the particular configuration described is only an example and is not the only one which will work. Upon engagement, the interior surface of the top 21 will be pressed upward, and the first surface 15 will be pressed downward putting inward pressure on the third surface 17 and on the first protrusion 24.

As seen in FIG. 3, a bottom section of the neck 12 is generally vertical, and its exterior surface includes the threaded-portion below the shoulder 13. That bottom section of the neck 12 is narrower than the adjacent and integral upper part of the base 11, and the skirt 22 is generally the same diameter as the upper part of the base 11.

As best seen in FIGS. 1 and 3, a gap 14 remains between a bottom edge of the cap 20 and an upper part of the base 11 in the illustrated embodiment, when tighter engagement between the cap 20 and the container 10 is blocked by contact between the stopping surfaces 13 and 23. The gap 14 facilitates the cutting of any label or tamper-evident tape applied to the filled cap and container assembly before sale to the consumer.

Figure 5:
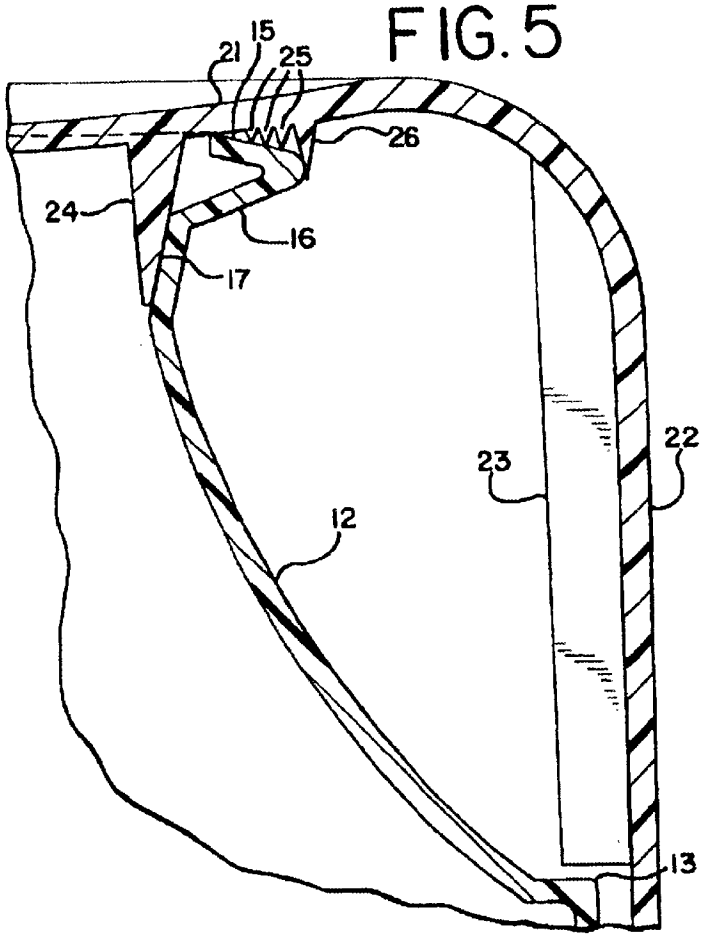
FIG. 5 is a similar view as illustrated in FIG. 4, but of an alternate embodiment; and, FIG. 6 is a detailed view of roughness values and textures that can be used in FIG. 4.

In an alternative embodiment illustrated, in part, in FIG. 5, an additional annular protrusion 26 depends down from the interior surface of the top 21. When the cap 20 is engaged with the container 10, the additional protrusion 26 is radially outside of the flexible lip of the neck 12, and is sufficiently rigid and extends low enough and close enough to the lip to resist the lip from moving outwardly when the lip is pressed down upon engagement of the cap 20 with the container 10. This will maintain the pressure on the first and third surfaces 15 and 17, and improve the cooperation between at least a portion of the first surface 15 and at least a portion of one or all of the second protrusions 25 and between at least a portion of the third surface 17 and at least a portion of the first protrusion 24. The additional annular protrusion 26 will compensate for manufacturing imperfections, such as a surface of the neck 12 being slightly out of the round, which would diminish the ability to achieve a good seal. The possibility of such imperfections cannot always be eliminated given the tolerances achievable in the manufacture of inexpensive containers.

In the alternate embodiment shown in FIG. 5, at least a portion of the additional annular protrusion 26 may also serve as a sealing surface of the container 10 cooperating with a sealing surface of the cap 20, which can be at least a portion of the neck 12. Preferably, this would be at least a portion of the second surface 16. In the alternate embodiment, although not shown in FIG. 5, at least a portion of the additional protrusion 26 may be roughened and at least a portion the second surface 16 may be roughened to allow for gas to flow into and/or out of the container assembly.

For purposes of construing this application, the articles "a" or "an" shall be construed to mean both singular or plural, and the connector "or" shall be construed to mean in the conjunctive.

The embodiments discussed and/or shown in the figures are examples. They are not exclusive ways to practice the present invention, and it should be understood that there is no intent to limit the invention by such disclosure. Rather, it is intended to cover all modifications and alternative constructions and embodiments that fall within the spirit and the scope of the invention as defined in the following claims:

What is claimed is:

1. A container assembly comprising: a container and a cap; the container including a base, and a neck for engagement with the cap, an end of the neck defining a container mouth; the neck being substantially symmetrical about a central vertical axis, the neck forming a flexible lip proximate the mouth, with an upper generally frusto-conical exterior sealing surface, the lip having a lower generally frusto-conical interior sealing surface; the cap including a top, a skirt depending peripherally from the top, at least one first annular sealing protrusions depending from an interior surface of the top, and at least one second annular sealing protrusion depending from an interior surface of the top; wherein, upon engagement of the cap with the neck, the first sealing protrusion sealingly engages the lower interior sealing surface, and the second sealing protrusion engages the, upper exterior sealing surface; and, wherein at least one of a group consisting of the interior sealing surface, the exterior sealing surface, at least a portion of the second sealing protrusion, and at least a portion of the first sealing protrusion is prepared to have a coarsened or polished surface so that gas can flow into or out of the container assembly as required and further including an additional annular protrusion depending from the interior surface of the top of said cap, the additional annular protrusion being radially outside of the first and second sealing protrusions and, upon engagement of the cap with the container, radially outside the lip; the additional annular protrusion being sufficiently rigid and extending low enough and close enough to the flexible lip upon engagement of the cap with the container, to resist the lip from moving outwardly.

2. The container assembly of claim 1 wherein the texture of at least two of a group consisting of the interior sealing surface, the exterior sealing surface, at least a portion of the second protrusion, and at least a portion of the first protrusion is prepared.

3. The container assembly of claim 1 wherein only the texture of the at least a portion of the at least one first sealing protrusion is prepared.

4. The container assembly of claim 1 wherein only the texture of the exterior sealing surface is prepared.

5. The container assembly of claim 1 wherein only the texture of the interior sealing surface is prepared.

6. The cap and container assembly of claim 1, wherein the container is manufactured of a flexible plastic material.

7. The cap and container assembly of claim 1, wherein the cap is manufactured of a flexible plastic material.

* * * * *